United States Patent [19]

Kraft

[11] Patent Number: 4,856,932

[45] Date of Patent: Aug. 15, 1989

[54] CONCRETE FINISHING FLOAT HAVING SPIRALLY SLOTTED SLEEVE

[76] Inventor: Simon Kraft, 7501 W. 99th Ter., Overland Park, Kans. 66212

[21] Appl. No.: 190,027

[22] Filed: May 4, 1988

[51] Int. Cl.[4] ..... E01C 19/22

[52] U.S. Cl. ..... 404/118; 404/97

[58] Field of Search ..... 404/97, 118–120; 15/235.8, 144 R; 16/110 R, 115; 425/458

[56] References Cited

U.S. PATENT DOCUMENTS

| | | | |
|---|---|---|---|
| 1,021,557 | 3/1912 | Runner | 404/97 X |
| 1,590,342 | 6/1926 | Abram | 15/235.8 |
| 1,713,513 | 5/1929 | Abram | 15/235.8 |
| 2,834,199 | 5/1958 | Freeman | 15/235.8 |
| 2,934,937 | 5/1960 | Bennett | 15/235.8 |
| 2,999,261 | 9/1961 | Lapham | 15/235.8 |
| 3,090,066 | 5/1963 | Ferrell et al. | 15/235.8 |
| 3,146,481 | 9/1964 | Chiuchiarelli | 15/235.8 |
| 3,162,881 | 12/1964 | Negwer | 15/235.8 |
| 3,729,765 | 5/1973 | Peterson | 15/235.8 |
| 3,798,701 | 3/1974 | Irwin et al. | 15/235.8 |
| 3,803,662 | 4/1974 | Glejf | 15/104 S |
| 4,335,485 | 6/1982 | Paine et al. | 15/235.8 |
| 4,397,581 | 8/1983 | Jarvis | 404/97 |
| 4,520,527 | 6/1985 | Maggio et al. | 15/235.8 |
| 4,702,641 | 10/1987 | Naser et al. | 404/97 |

*Primary Examiner*—Jerome W. Massie, IV
*Assistant Examiner*—Gay Ann Spahn
*Attorney, Agent, or Firm*—Litman, McMahon & Brown

[57] ABSTRACT

A long-handled float device for leveling wet concrete includes mechanism attaching a handle to a float which is adapted to allow a user to adjust the relative angle between the float and the handle. The adapter connecting the shaft to the float includes a yoke, a yoke shaft coupler, a sleeve through which a sleeve guide shaft passes, and a link arm which connects the sleeve to the yoke. Rotation of the handle about its own axis causes sleeve guide shaft rotation which causes movement of the sleeve along the guide shaft axis which is transmitted to the yoke via a link arm causing the angular relationship between the float and the handle to change. By such adjustment, the user may tilt the front float edge upward when the assembly is pushed away from the user. Upon reversing direction, the user may tilt the back float edge upward.

8 Claims, 2 Drawing Sheets

CONCRETE FINISHING FLOAT HAVING SPIRALLY SLOTTED SLEEVE

BACKGROUND OF THE INVENTION

1. Field of the Invention

This invention relates to a concrete finishing tool which allows a user to adjust the angle of a concrete finishing float as it is being pulled towards or pushed away from the user.

2. Background Discussion

It is frequently necessary to use a cement finishing float for the purposes of providing a smooth finish to large slabs of concrete or to establish a wet cement surface gradient. It is desirable that such tools be provided with a means for tilting the float work face from the remote end of a handle connected to the float to facilitate the forward pushing and backward pulling of the float as it moves over the wet soft cement surface. Long reach floats are necessary as it is undesirable to walk over an unset cement surface since to do so would disturb the natural settling and separation processes associated with cement curing.

The prior art discloses a number of devices for tilting the float relative to the handle. However, typically such devices are complicated and cumbersome to operate and often are ineffective. The devices also suffer disadvantages such as susceptibility to wear, difficulty of maintenance, and torque problems associated with the use of long handled shafts.

In particular, the Chiuchiarelli U.S. Pat. No. 3,146,481 discloses an extremely complicated device, which because it has internally located slots, is especially susceptible to wear and difficulty of maintenance. In between uses wet cement which collected during use hardens and binds the spirally slotted mechanism. Cleaning of the slots is made very difficult because the internally located slots are not fully accessible without disassembly of the tilting mechanism. If operation of the tilting mechanism is attempted when it is bound with or soiled by hardened cement set up in the internally located slots, damage to the wear surfaces quickly results.

SUMMARY OF THE INVENTION

This invention relates to an improved concrete finishing float tool which provides a reliable and easy way to change the angle of incidence of the concrete float relative to its handle by the user's rotation of the handle at some remote distance from the float. Further, the tilt control mechanism is provided with a spirally slotted sleeve which because of its accessibility can be readily cleaned of abrasive materials which damage bearing surfaces during use and greatly reduce the life of the mechanism. The float is easily disconnected from the handle to facilitate cleaning and storage.

This concrete finishing float includes an elongated handle having a float attached at one end. The means of handle-float attachment includes a yoke attached to the float, a yoke-shaft coupler extending through and pivotally connected to the yoke, a link arm connected on the upper end of the yoke, a sleeve guide shaft pivotally connected to the yoke-shaft coupler to allow rotation of the sleeve guide about its axis while connected to the non-rotating yoke-shaft coupler, a sleeve which slides on the sleeve guide shaft and which is pivotally connected to the link arm, and a handle receiving means attached to the handle end of the sleeve guide shaft. The handle receiving means has a spring-loaded detent which extends radially from apertures in the handle receiving means. The handle shaft is mounted exteriorly of the handle receiving means allowing the detent to selectively prevent inadvertent withdrawal of the handle from the float. The link arm tilts the yoke and the float fixedly connected to the yoke when the user rotates the handle.

OBJECTS OF THE INVENTION

The objects of the present invention are: to provide an improved concrete finishing float tool which provides a reliable and easy way to change the angle of incidence of the float relative to the handle by the user's rotation of the handle at a remote location; to provide such a tool with easily accessible parts and sleeve bearing surfaces to allow easy cleaning; to provide such a concrete finishing float which permits easy assembly and disassembly for storage purposes; to provide a strong, durable, and uncomplicated mechanism which will withstand a relatively torturous environment; to provide such a concrete finishing float which is efficient in operation, economical to manufacture, capable of long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 4:
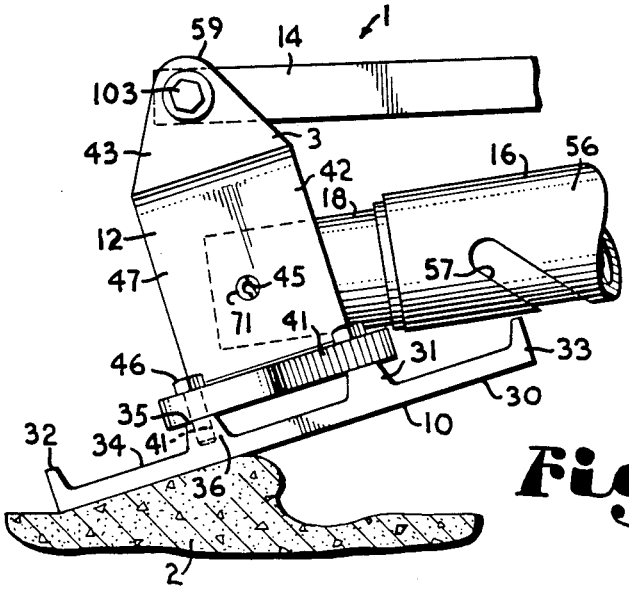
FIG. 4 is a fragmentary side elevation showing the position of the float as the device is being pulled toward the operator.
Figure 5:
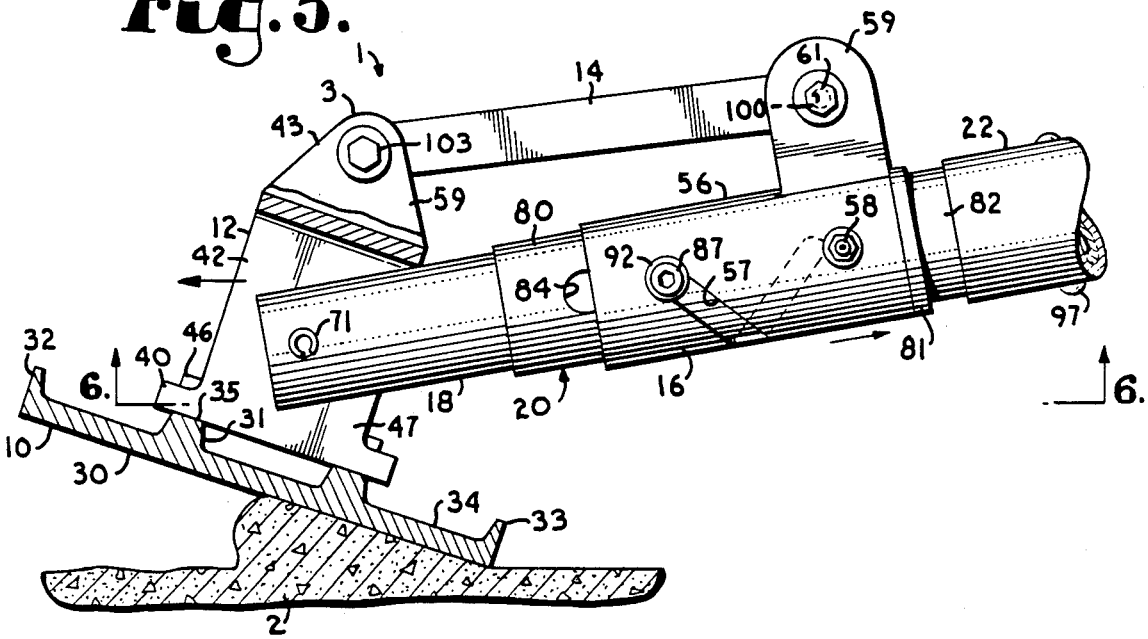
FIG. 5 is a fragmentary cross-sectional side elevation of the tool showing the yoke shaft coupler pivotally attached to the yoke and the relative positions of the float and the user handle as the device is pushed away from the operator.
Figure 6:
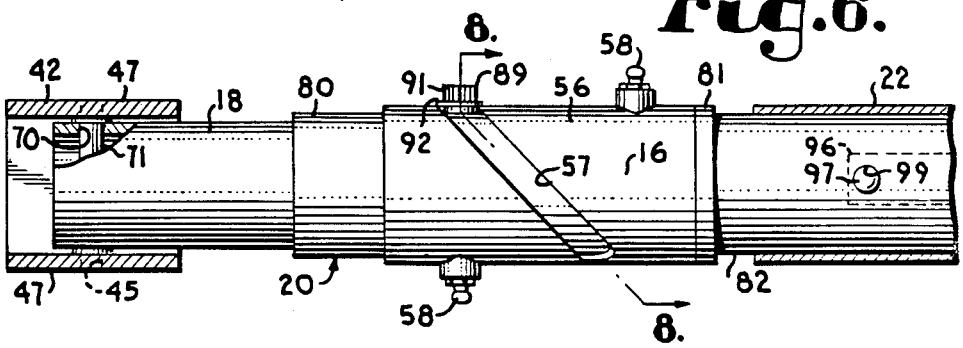
FIG. 6 is a fragmentary, cross-sectional view showing a yoke shaft pivotally attached to the yoke.
Figure 7:
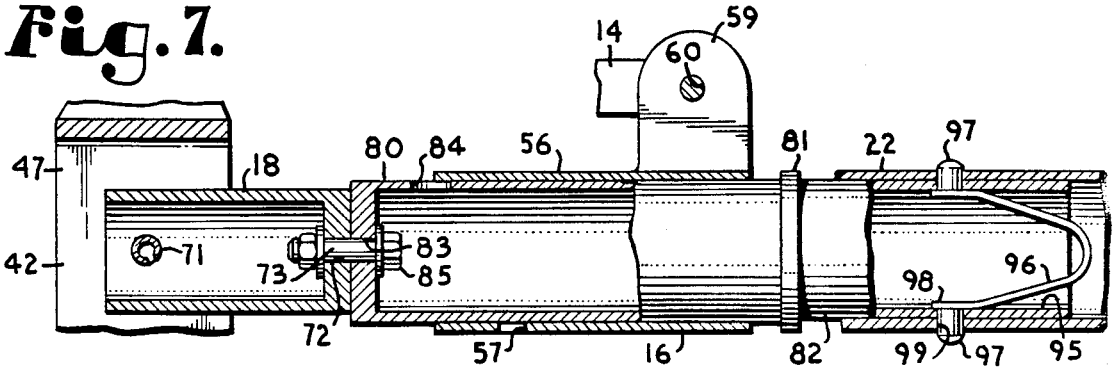
FIG. 7 is a fragmentary, cross-sectional side elevation of the yoke shaft coupler showing details of construction.
Figure 8:
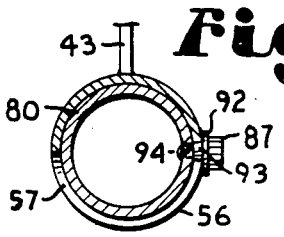
FIG. 8 is a fragmentary, cross-sectional view through the sleeve shown mounted on the sleeve guide shaft and rotated to a position including the float away from the operator.
Figure 9:
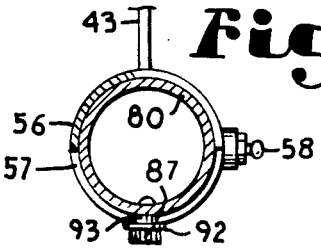
FIG. 9 is a view similar to FIG. 8 but showing a sleeve position corresponding to an intermediate angle of float incidence.

The terms "front" and "back" and similar terms refer to directional orientations to the left and right respectively of the concrete finishing float as oriented in FIGS. 4 and 5. The terms "inner" and "outer" and similar terms refer to directional orientations in relation to the longitudinal centerline of the concrete finishing float.

Referring to the drawings in more detail, the concrete finishing float 1 is of the type that might be used in providing a smooth finish to a large surface area of wet cement surface 2. The concrete finishing float 1 having a concrete float tilting mechanism 3 which comprises a float 10, a support means, in this example, in the form of a yoke assembly 12, a link age means 14, a sleeve assembly 16, a pivotal hinge member, in this example, in the form of a yoke-shaft coupler 18, a sleeve guide shaft assembly 20, and an elongated shaft 22.

Figure 1:
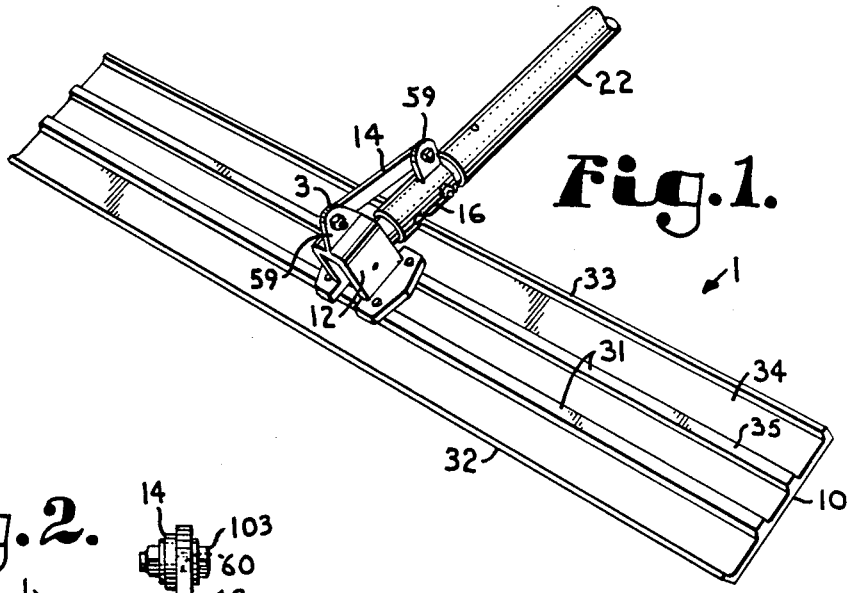
FIG. 1 is perspective view of a concrete finishing float embodying the present invention.
Figure 2:
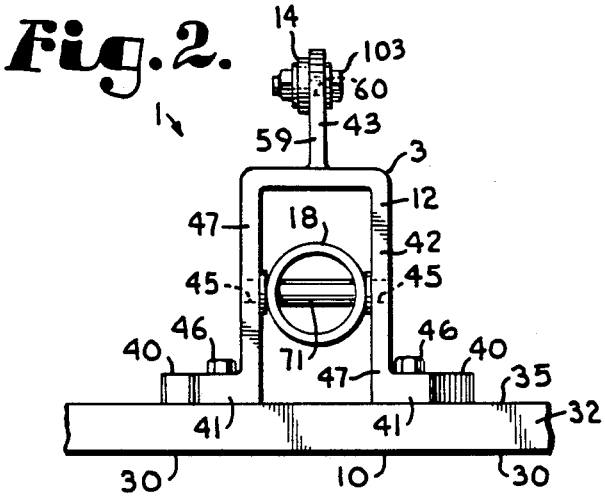
FIG. 2 is a fragmentary, front elevational view of the concrete finishing tool showing a yoke attached to the float.
Figure 3:
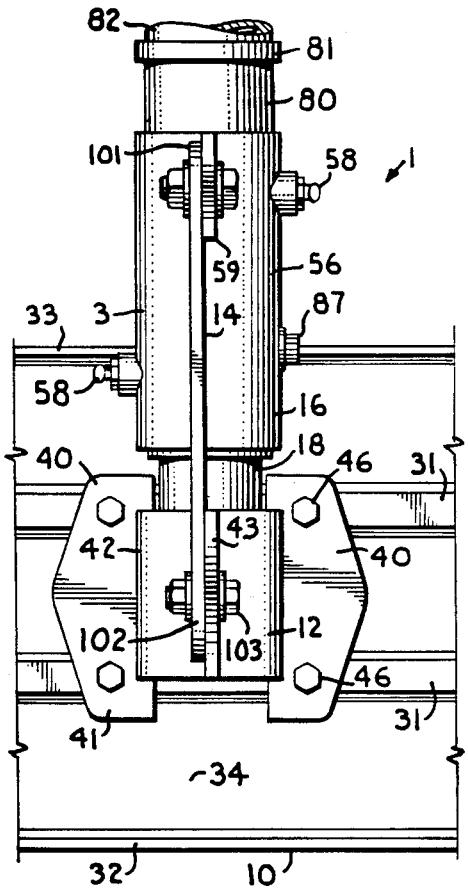
FIG. 3 is a fragmentary plan view showing a control sleeve on a sleeve guide shaft and a link arm engaged with the yoke and the sleeve.

The float 10 comprises a rectangular surfacing face 30, a pair of central longitudinal ribs 31, a front longitudinal rib 32, a back longitudinal rib 33, a top face 34, an attachment surface 35, and rib mounting apertures 36 (although a ribbed, rectangular surfacing float is shown in FIG. 1, it is foreseen that other conventional floats, trowels, or the like may be used with the invention). In use, the rectangular surfacing face 30 interfaces with the wet concrete surface 2 to create the desired surface gradient or texture. The center pair of longitudinal ribs 31, the front longitudinal rib 32, and the back longitudinal rib 33 extend along the top face 34 and are provided to improve the structural strength of the float and also to provide an attachment surface 35 for the yoke assembly 12. The top face 34 is the upper surface of the float 10 as it is oriented when in use. Rib mounting threaded apertures are positioned in the attachment surface 35 which is centrally positioned on each central longitudinal rib 31. The yoke assembly is attached to the float 10 on the attachment surface 35.

The yoke assembly 12 comprises a pair of mounting brackets 40, mounting apertures 41, a yoke support 42, a yoke link arm bracket 43, a yoke link arm bracket aperture 44, a yoke spring pin aperture 45, fasteners, in this example, in the form of yoke mounting bolts 46, and a pair of yoke members 47. The yoke support 42 when mounted to the float 10 is inverted relative to the top face 34 of the float 10. The yoke support 42 opening is oriented in perpendicular relationship to the longitudinal axis of the float 10. The yoke support 42 comprises two yoke members 47 on the bottom of which are mounted the yoke mounting brackets 40. Extending upwardly from the yoke support 42 is the yoke link arm bracket 43, the plane of which is perpendicular to the longitudinal axes of the float 10. In the yoke link arm bracket 43 is the yoke link arm bracket aperture 44 the central axes of which is parallel to the longitudinal axis of the float 10. Two pair of yoke mounting bolts 46 are inserted through mounting apertures 41 threadably engaging the rib mounting apertures 36. The pair of spring pin apertures 45 are centrally located in the yoke members 47 and the axes of which are parallel to the longitudinal axes of the float 10.

The sleeve assembly 16 comprises a sleeve 56, slot 57, a lubrication application means, in this example, in the form of a pair of grease zerks 58, a sleeve link arm bracket 59, and a sleeve link arm bracket aperture 60. The sleeve 56 is of tubular design. On the top of the sleeve 56 the sleeve link arm bracket 59 is mounted in a plane which projects radially from the longitudinal axes of the sleeve 56. The sleeve link arm bracket aperture 60 is centered in the sleeve link arm bracket 59 and its central axes is perpendicular to the central axis of the elongated shaft 22. The slot 57 is positioned in the lower half of the sleeve 56 relative to the sleeve link arm bracket 59. The slot 57 has a spiral path in the lower half of the sleeve 56 with its path progressing toward the floating end of the handle as the spiral proceeds in a clockwise direction facing the float end of the concrete finishing float from the elongated shaft 22. The grease zerks 58 are mounted on the sides of the sleeve 56 for the introduction of lubrication between the sleeve 56 and the sleeve guide 80.

The yoke shaft coupler 18 is tubular in shape and at its front end has a spring pin shaft aperture 70 of a diameter slightly larger than a spring pin 71 which is used to pivotally attach the yoke shaft coupler 18 to the yoke 42. The spring pin 71 is of a slightly larger diameter than both the spring pin shaft aperture 70 and the yoke spring pin aperture 45 and the yoke support 42. The yoke shaft coupler 18 is mounted to the yoke support 42 by positioning its front end between the yoke members 47 such that its spring pin shaft aperture 70 axially aligns with the yoke spring pin apertures 45 in the yoke members 47. Once aligned, the spring pin 71 is forced through a first yoke spring pin aperture 45, through the spring pin shaft aperture 70 and finally through a second yoke spring pin aperture 45. Once so attached, the yoke shaft coupler 18 may be pivoted about the spring pin longitudinal axis as it is centered in the yoke support 42. The yoke shaft coupler 18 is relatively short and at its opposite end is a connector bolt aperture 72 through which a connector bolt 73 is inserted.

The sleeve guide shaft assembly 20 comprises a sleeve guide 80, a collar 81, a handle shaft receiving member 82, a connector bolt aperture 83, an access aperture 84, and a nut 85. The sleeve guide shaft assembly 20 is tubular in shape and of an outer diameter slightly larger than that of the yoke shaft coupler 18. The sleeve guide 80 comprises the front portion of the sleeve guide shaft assembly 20 and is of an outer diameter slightly larger than the outer diameter of the yoke shaft coupler 18. The outer diameter of the sleeve guide shaft assembly is also slightly less than the inner diameter of the sleeve 56. At the front end of the sleeve guide 80 is a connector bolt aperture 83, the central axes of which aligns with the longitudinal axes of the sleeve guide shaft assembly 20. The connector bolt aperture 83 is of a diameter identical to that of the connector bolt aperture 72 in the yoke shaft coupler 18.

The collar 81 is positioned between the sleeve guide 80 and the handle shaft receiving member 82 and is of a slightly larger diameter than that of the sleeve guide 80 and of the inside diameter of the sleeve 56. The collar 81 blocks the travel of the sleeve 56 as it travels toward the user. Connected to the user end of the sleeve guide 80 is the handle shaft receiving member 82, the outer diameter of which is identical to that of the sleeve guide 80. The handle shaft receiving member 82 is of sufficient length to allow the float end of the handle shaft 22, which is of a slightly larger diameter than the handle shaft receiving member 82, to be externally mounted and tightly fitted such that rotation of the elongated shaft 22 is transmitted through the handle shaft receiving member 82 to the sleeve guide 80.

The sleeve guide 80 is manufactured with an access aperture 84 positioned at its front end and the central axis of which is perpendicular to the longitudinal axes of sleeve guide shaft assembly 20. The access aperture 84 provides access for the mounting of a nut 85 on the connector bolt 73 inserted through both the connector bolt aperture 72 and the connector bolt aperture 83. The connector bolt 73 and nut 85 are sufficiently tightened to abut the ends of the yoke shaft coupler 18 to the sleeve guide shaft assembly 20 yet loose enough that rotation of the sleeve guide shaft assembly 20, relative to the yoke shaft coupler 18, is permitted.

Inserted through the slot 57 and fixedly attached to the sleeve guide 80 is a cam member, in this example, in the form of a slott fitting 87 threadably attached to the sleeve guide 80 and extending radially outward therefrom. The slot fitting 87 comprises a bolt, in this example, in the form of a threaded section 90, a fitting head 91, a washer 92, and a bushing 93. The threaded section 90 of the slotted fitting 87 is threaded into a threaded aperture 94 in the sleeve guide 80, the central axes of which extends radially from the longitudinal axes of the sleeve guide 80. The bushing 93 is of an outer diameter slightly less than the width of the slot 57 and is of an inner diameter slightly greater than the diameter of the threaded section 99 of the slot fitting 87. The width of the bushing 93 is slightly greater than the wall thickness of the sleeve 56. A washer 92 with an inner diameter slightly greater than the threaded section 99 and with an outer diameter greater than the width of the slot 57 is inserted on the threaded section 99 and abuts against the fitting head 91. Abutting against the washer 99 is the bushing 93. The bushing 93 is fitted in the slot 57 when the slot fitting 87 is mounted to the sleeve guide 80 threaded aperture 94.

The handle shaft receiving member 82 has a detent spring bore 95 for receiving a detent spring 96. The detent spring 96 is generally "u" shaped with a pair of detents 97 positioned in each of a pair of detent spring legs 98. The detents 97 are positioned in the detent spring legs 98 such that when it is inserted in the detent spring bore 95 of the handle shaft receiving member 82 the detents 97 align with and are inserted into a pair of detent apertures 99 positioned in the front end of the elongated shaft 22 at the opposite end of a radial axes of the elongated shaft 22. The width of the detents 97 is slightly less than the diameter of the detent apertures 99 such that the elongated shaft 22 will be securely fastened when it is positioned over the handle shaft receiving member 82.

The link age means 14 has link arm mounting apertures 100 at each of its ends. A first link arm end 101 is pivotally connected to the sleeve link arm bracket by a bolt and nut connector 61, a second link arm end 102 is pivotally connected to the yoke link arm bracket 43 by a bolt and nut connector 104. The link arm 14 is of a sufficient length that as the sleeve 56 travels through its range the float 10 rotates fully through its angle range relative to the elongated shaft 22.

As best shown in FIGS. 4, 5, 8 and 9 this invention is used to manually manipulate the incidence of the angle of the float 10 and change this angle of incidence depending on whether the float 10 is being pulled toward the user or pushed away from the user. The user holds the concrete finishing float 1 in position by means of the elongated shaft 22. By manually twisting the elongated shaft 22 from a remote location, the rotational movement causes the handle shaft receiving member 82, the sleeve guide 80 and the slot fitting 87 within the slot 57 to likewise rotate. As the slot fitting 87 is rotated in the slot 57, it forces the sleeve 56 to move toward or away from the yoke assembly 12. As the sleeve 56 moves its longitudinal motion is transmitted, via the link age means 14, to the yoke link arm bracket 43, causing the yoke assembly 12 to rotate about the spring pin 71 axes. The rotation of the yoke support 42 about the spring pin 71 axes establishes the angle of incidence of the float 10 relative to the longitudinal axes of the elongated shaft 22 and also relative to the wet cement surface 2. When the user is pushing the float 10 forward, the front edge of the float 10 is inclined upward by rotating the elongated shaft 22 fully clockwise. When the user pulls the concrete finishing float backwards, the back edge of the float 10 may be inclined by rotating the elongated shaft 22 fully counterclockwise.

It is to be understood that while certain forms of the present invention have been illustrated and described herein, it is not to be limited to the specific forms or arrangement of parts described and shown.

What is claimed and desired to be secured by Letters Patent is as follows:

1. A concrete float tilting mechanism adapted for connection to a concrete float, comprising:

(a) a support means mounted on said float;

(b) an elongated shaft rotatably connected to said support means and extending transversely to said float;

(c) a sleeve, said shaft rotatable in said sleeve;

(d) linkage means pivotally secured to said sleeve and to said support means, said linkage means permitting tilting of said support means with respect to said shaft but preventing rotation of said sleeve with respect to said support means;

(e) a cam member projecting laterally from said shaft;

(f) a slot formed generally in the lower half of said sleeve and spirally extending thereabout, said slot receiving said cam member thereto;

(g) whereby rotational movement of said shaft produces linear movement of said sleeve on said shaft which translates to tilting motion of said float.

2. A concrete float tilting mechanism adapted for connection to a concrete float, comprising:

(a) a yoke support; fasteners securing said yoke support on said float; said yoke support including mounting brackets extending therefrom and including an aperture formed therein;

(b) an elongated shaft, a pivotal hinge member axially connecting said shaft to said yoke support, said pivotal hinge member cooperatively engaging said yoke support whereby said shaft extends transversely to said float, and is permitted to tilt with respect thereto;

(c) sleeve, said shaft rotatable in said sleeve, lubrication application means mounted on said sleeve and adapted to introduce lubricant between said sleeve and said shaft for ease of relative movement therebetween;

(d) a link bracket extending from said sleeve;

(e) a link having a first end and a second end, said link first end being pivotally secured to said link bracket; said link second end being pivotally secured to said yoke support whereby said link permits tilting of said yoke support means with respect to said shaft but prevents rotation of said sleeve with respect to said support means;

(f) a bolt extending laterally from said shaft;

(g) a slot formed through the thickness of said sleeve and spirally extending generally about a lower half of said sleeve, said bolt extending into said slot and urging said sleeve axially with respect to said shaft upon rotation of said shaft;

(h) whereby rotational movement of said shaft translates to tilting motion of said float.

3. The mechanism as set forth in claim 1 wherein:

(a) said support means is in the shape of a yoke extending to opposite sides of said shaft.

4. The mechanism as set forth in claim 1 wherein:

(a) said elongated shaft including a pivotal hinge member axially connecting said shaft to said support means, said pivotal hinge member cooperatively engaging said support means whereby said shaft extends transversely to said float, and is permitted to tilt with respect thereto.

5. The mechanism as set forth in claim 1 wherein:

(a) said sleeve including a lubrication application means mounted on said sleeve and adapted to introduce lubricant between said sleeve and said shaft for ease of relative movement therebetween.

6. The mechanism as set forth in claim 1 wherein:

(a) said linkage means including a link having a first end and a second end, said link first end being pivotally secured to said bracket; said link second end being pivotally secured to said support means whereby said link permits tilting of said support means with respect to said shaft but prevents rotation of said sleeve with respect to said support means.

7. The mechanism as set forth in claim 1 wherein:

(a) said cam member is in the shape of a bolt extending laterally from said shaft; said bolt extending in said slot and urging said sleeve axially with respect to said shaft upon rotation of said shaft.

8. A concrete float tilting mechanism adapted for connection to a concrete float, comprising:

(a) a support means mounted on said float;

(b) an elongated shaft rotatably connected to said support means and extending transversely to said float;

(c) a sleeve, said shaft rotatable in said sleeve;

(d) linkage means pivotally secured to said sleeve and to said support means, said linkage means permitting tilting of said support means with respect to said shaft but preventing rotation of said sleeve with respect to said support means;

(e) a cam member projecting laterally from said shaft;

(f) a slot formed through the thickness of said sleeve and spirally extending less than 360° thereabout, said slot receiving said cam member thereto;

(g) whereby rotational movement of said shaft produces linear movement of said sleeve on said shaft which translates to tilting motion of said float.

* * * * *